United States Patent [19]

Kusz

[11] Patent Number: 4,645,087

[45] Date of Patent: Feb. 24, 1987

[54] TAMPER INDICATING DEVICE

[75] Inventor: Maximillian Kusz, Waterville, Ohio

[73] Assignee: Owens-Illinois, Inc., Toledo, Ohio

[21] Appl. No.: 805,025

[22] Filed: Dec. 5, 1985

Related U.S. Application Data

[63] Continuation-in-part of Ser. No. 669,556, Dec. 17, 1984, abandoned.

[51] Int. Cl.[4] ..... B65D 41/34

[52] U.S. Cl. ..... 215/254; 215/274; 292/256.61; 220/319

[58] Field of Search ..... 215/254, 274; 220/319; 292/256.6, 256.61

[56] References Cited

U.S. PATENT DOCUMENTS

| | | | |
|---|---|---|---|
| 1,521,731 | 1/1925 | Taliaferro et al. | 220/319 |
| 1,761,714 | 6/1930 | Fink | 292/256.61 X |
| 2,037,920 | 4/1936 | Punte | 292/256.61 X |
| 2,080,983 | 5/1937 | Merolle | 215/274 |
| 2,314,452 | 3/1943 | Ljungstrom | 292/256.61 |
| 3,511,402 | 5/1970 | Cheeley | 215/254 |
| 3,693,820 | 9/1972 | Linkletter | 215/274 X |
| 3,913,771 | 10/1975 | Acton et al. | 215/274 X |

*Primary Examiner*—Donald F. Norton

*Attorney, Agent, or Firm*—John R. Nelson

[57] ABSTRACT

Five embodiments of a tamper indicating molded plastic band that locks over a ledge on the closure and beneath a flange on the container. The cylindrical band is molded with continuous locking rings or interrupted tabs joined adjacent the top end bottom edge thereof and which extend inwardly and generally toward each other to form mechanical locking members. Depending upon the particular arrangement of the locking rings on the tamper indicating band, the band would be applied to the closure before or after threaded application to the container. The band may be used with a plastic or metal closure and with a plastic, metal or glass container having a threaded neck and outwardly extending radial flange therebelow beneath which the ring or tab will lock.

16 Claims, 13 Drawing Figures

TAMPER INDICATING DEVICE

This application is a Continuation-in-Part of application Ser. No. 669,556 filed on 12/17/84 now abandoned.

This invention relates to a tamper indicating band that, when assembled with a threaded closure and container, will lock over a lower bead on the closure and beneath a radial flange or transfer bead on the container. The band is made of one piece construction and so configured that its removal can only be accomplished by destroying the integrity of the band, thus providing an indication that the closure may have been removed from the container.

BACKGROUND OF THE INVENTION

Tamper indicating closures are not entirely novel in the closure art and have assumed various forms. In most instances the tamper indicating feature is formed as an integral part of the closure and after the closure is applied to the container, a portion of the closure must be broken in order to remove the closure.

The molding of such closures is quite expensive from the viewpoint of the cost of molds, the tooling to make the molds and for that reason more economical systems are being considered. One system is a threaded closure having a tamper indicating band attached to its lower rim by a plurality of frangible connectors and the band seats in an annular area of the container neck with a series of lugs. The band must be removed in order for the closure to be rotated off the finish of the container. Such a system is disclosed in U.S. Pat. No. 3,980,195, issued on Sept. 14, 1976.

Another prior art system is illustrated in U.S. Pat. No. 4,454,955, issued June 19, 1984.

While the foregoing systems have had wide acceptance and success in the trade, they are only good with plastic, injection molded closures, and effective systems that would work equally well with a metal closure or plastic closure have not been available. Metal closures have typically been fixed in place on threaded necks of bottles by a shrink band that overlaps the closure and bead of the container finish. These require cutting the band in a horizontal area below the closure or in some cases the band has vertical lines of perforation that can be torn to permit removal of the band. They are either stretched before application or shrunk, such as with heat, after application. Special tools and handling systems are required in the capping line to apply the band.

Roll-on metal closures have been used where a lower frangible ring is crimped under the transfer bead of the container when the cap is formed around the threads. Such a system is illustrated in U.S Pat. No. 3,601,273, issued Aug. 24, 1971.

SUMMARY OF THE INVENTION

It is an object of the present invention to provide a plastic tamper indicating band that is pre-molded separate from the closure and which may be applied with the closure to a container that has a radial flange or bead just below the threads on the neck. The band of the invention is equally useable with either a molded plastic closure or metal closure with a lower annular bead. The band is molded as a single integral member that is applied axially over the closure and container neck and is formed with a first locking surface that engages the top of the annular bead at the lower end of the closure and a second locking surface that engages beneath a radial flange formed on the container.

It is an additional object of this invention to provide a tamper indicating band of pre-molded plastic that is useable with either a plastic closure or metal closure and a glass or plastic container.

Other and further objects will be apparent from the following description taken in conjunction with the annexed sheets of drawings.

Figure 1:
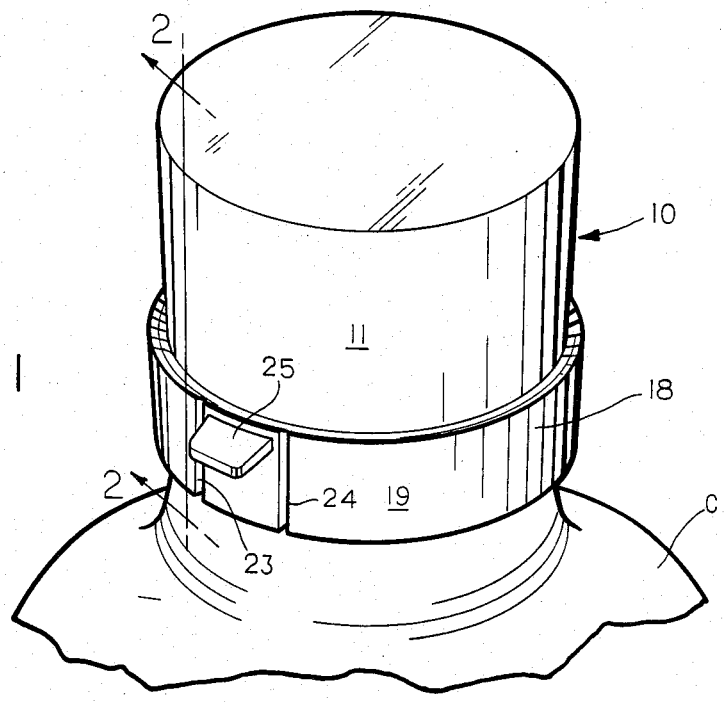
FIG. 1 is a perspective view of the tamper indicating band of the invention applied to a closure and container combination.
Figure 2:
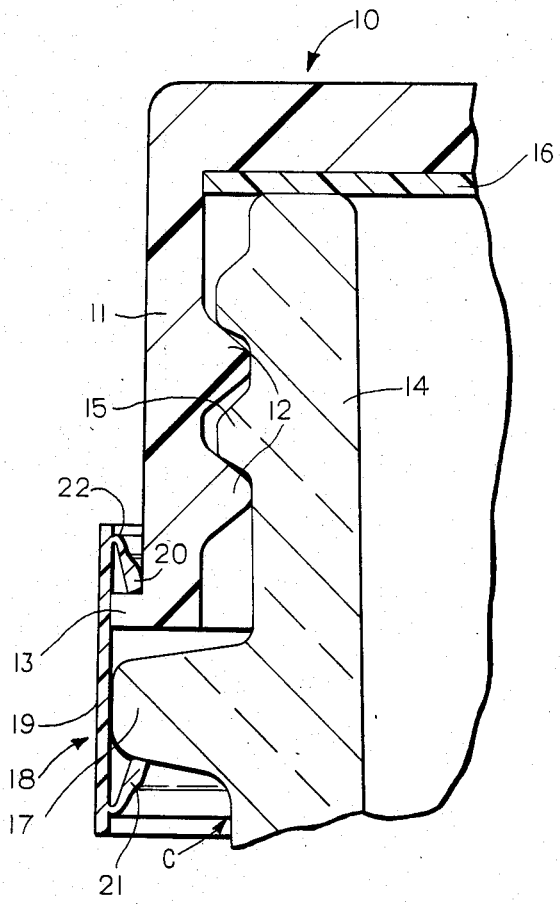
FIG. 2 is a vertical, cross-sectional view on an enlarged scale, taken at line 2—2 of FIG. 1.
Figure 11:
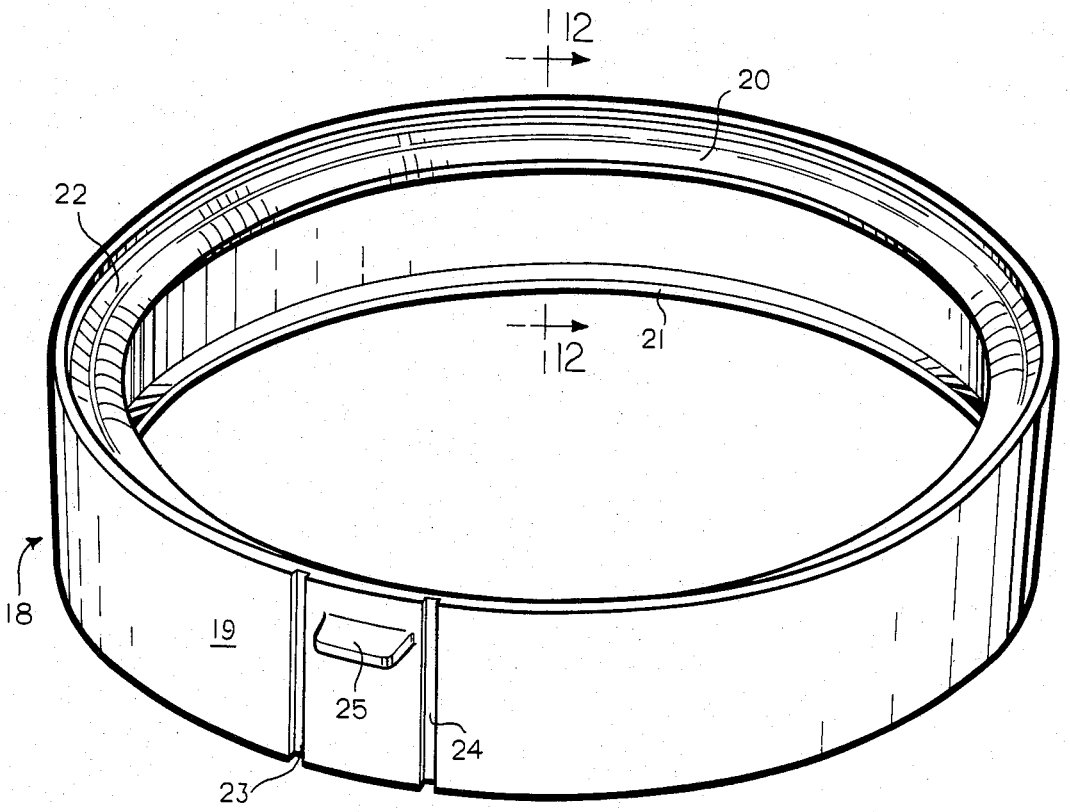
Figure 3:
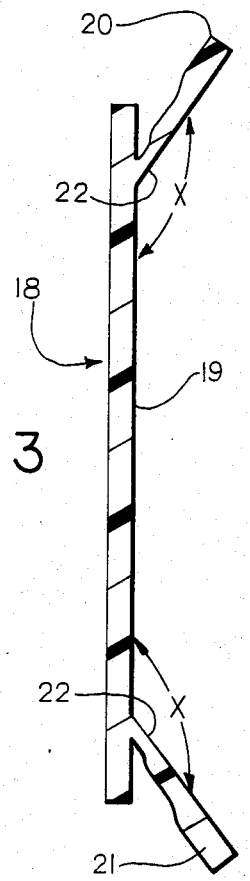
FIG. 3 is a cross-sectional view on an enlarged scale through the band of FIGS. 1 and 2 in its "as-molded" form and taken at line 3—3 of FIG. 9.
Figure 12:
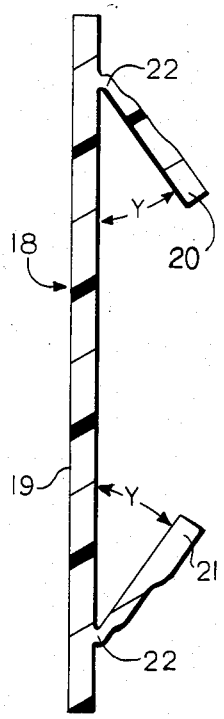
Figure 4A:
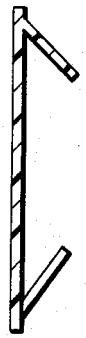
FIG. 4 is a perspective view of a second embodiment of the tamper indicating band of the invention.
Figure 4:
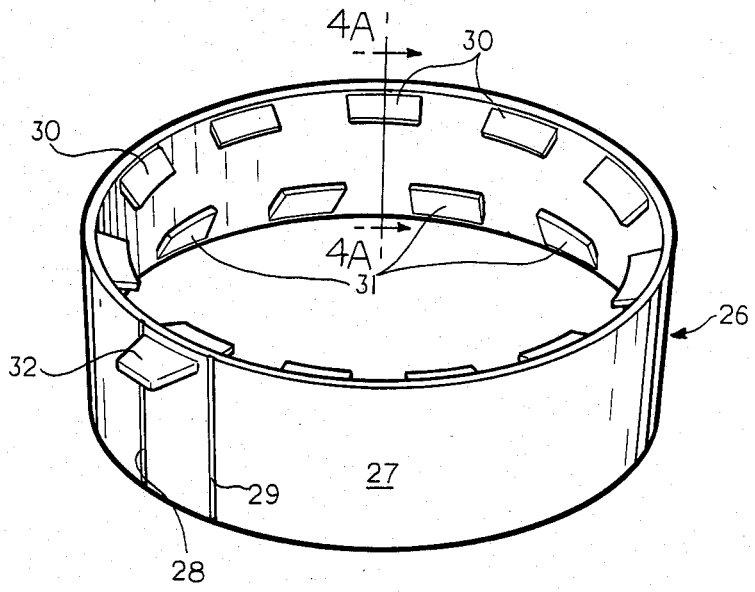
Figure 6:
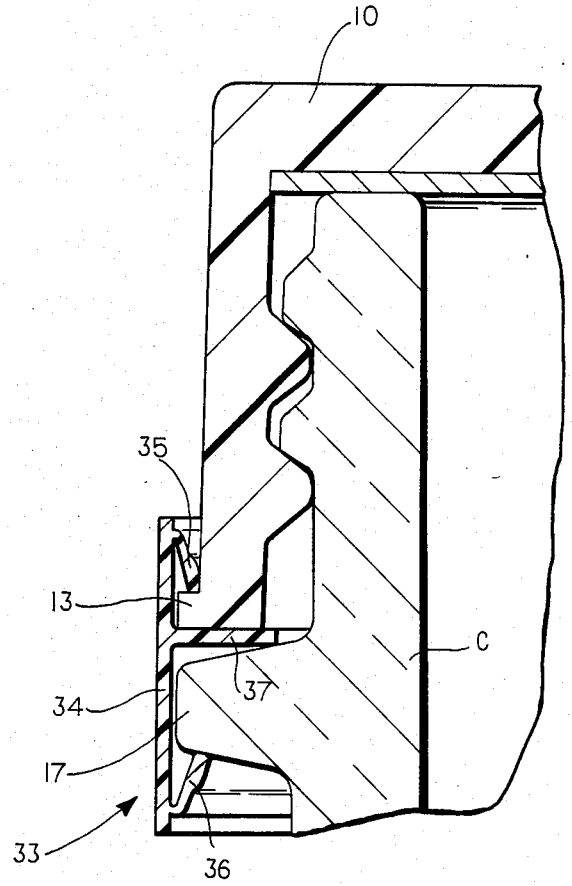
Figure 5:
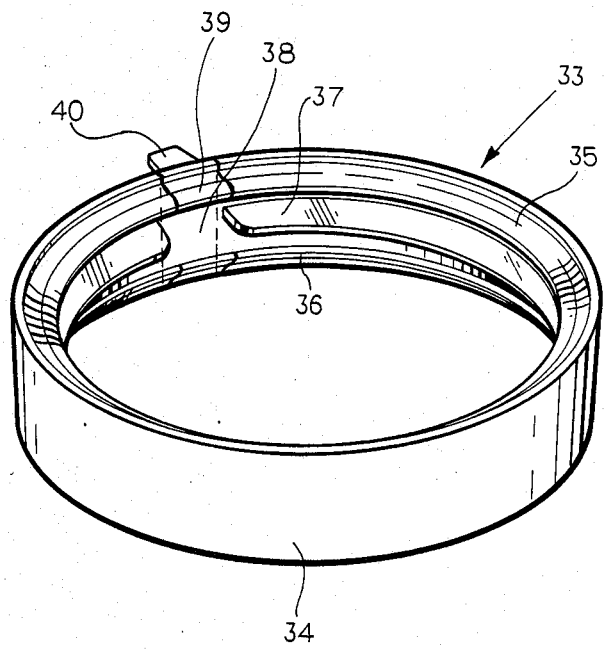
Figure 7:
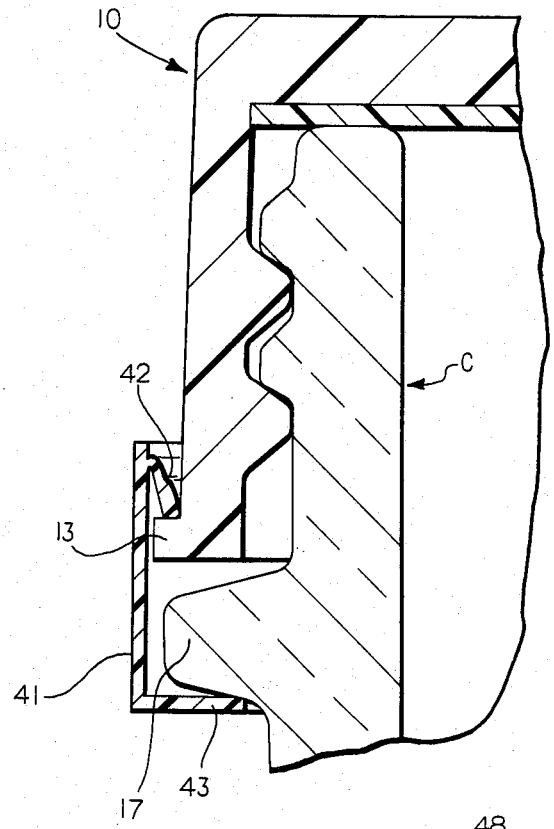
Figure 8:
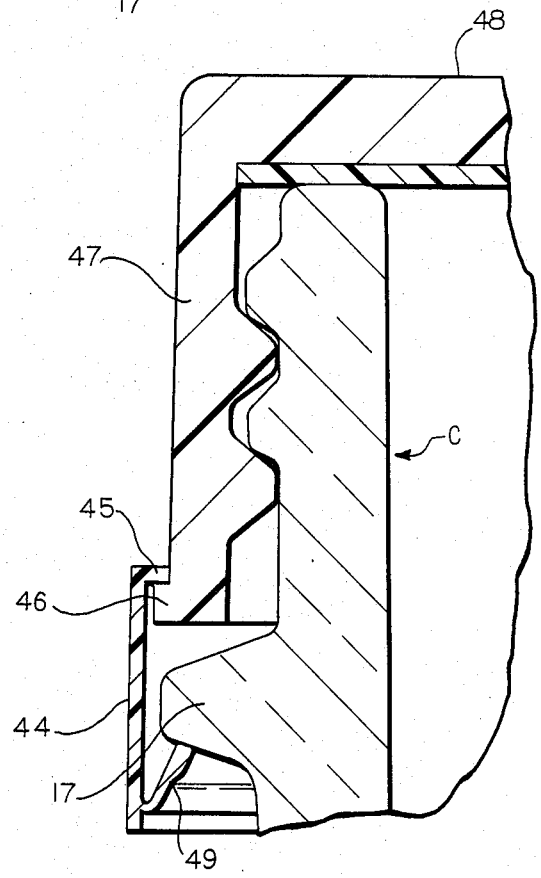
Figure 9:
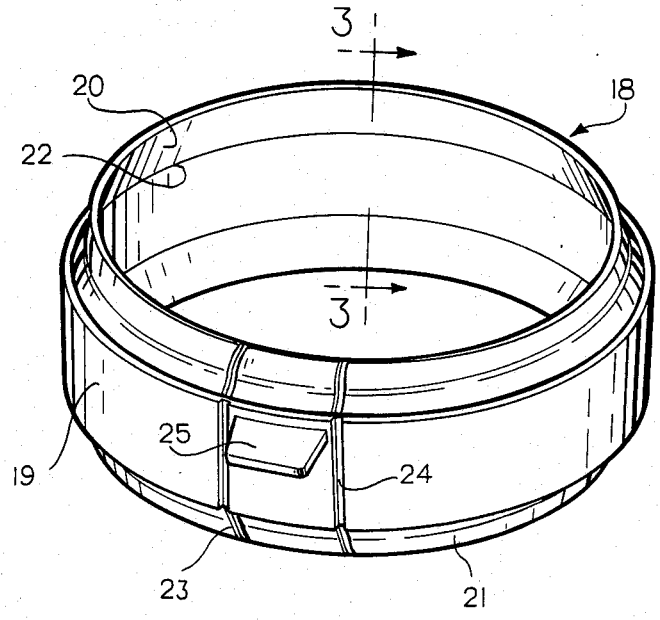
Figure 10:
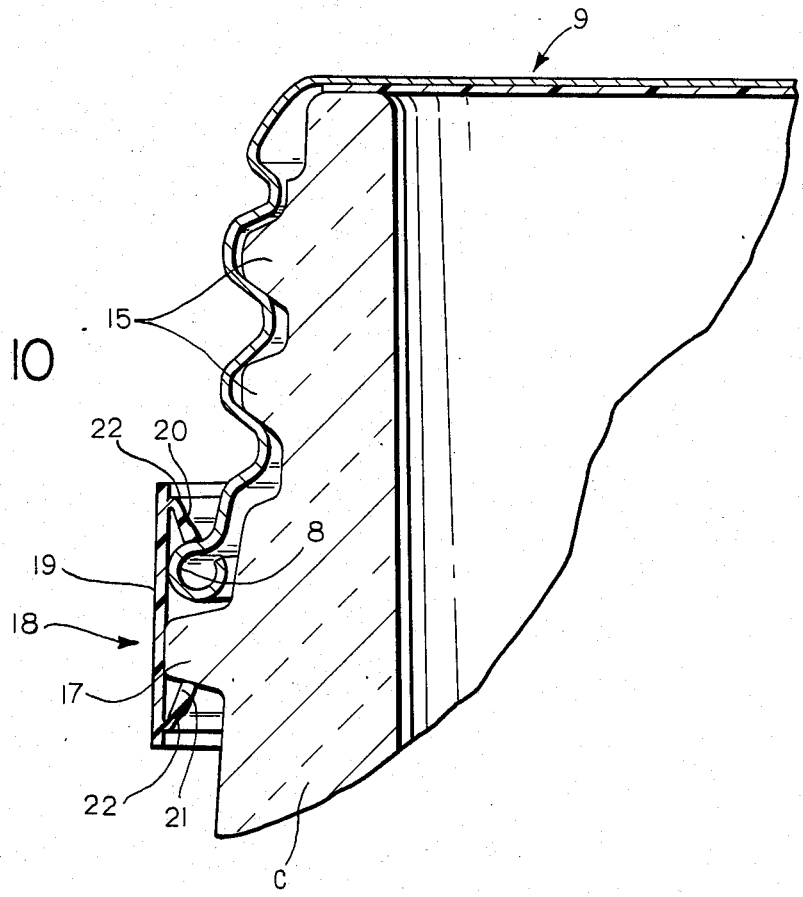

FIG. **4*a* is a cross-sectional view on an enlarged scale taken at line 4*a*—4*a* of FIG. 4**;

FIG. 5 is a perspective view of a third embodiment of the tamper indicating band of the invention;

FIG. 6 is a cross-sectional view on an enlarged scale illustrating the band of FIG. 5 applied to a closure and container combination;

FIG. 7 is a cross-sectional view similar to the view of FIG. 2, illustrating a still further, fourth embodiment of the band of the invention applied to a closure-container combination;

FIG. 8 is a cross-sectional view similar to FIG. 7 illustrating a fifth embodiment of the tamper indicating band of the invention;

FIG. 9 is a perspective view of the band of FIGS. 1 and 2 in its "as-molded" form;

FIG. 10 is a vertical, cross-sectional view similar to FIG. 2 illustrating the band of FIGS. 3 and 9 applied to a metal closure,and glass bottle combination;

FIG. 11 is a perspective view of the band illustrated in FIG. 9 in its "tucked" position; and FIG. 12 is a cross-sectional view on an enlarged scale taken at line 12—12 of FIG. 11.

DETAILED DESCRIPTION OF THE DRAWINGS

With particular reference to FIGS. 1-3, 9, 11 and 12, a first embodiment of the invention in this application will be described.

A cap generally designated 10 is formed with an annular skirt portion 11 having inwardly extending threads 12. The lower end of the skirt 11 has a radially, outwardly extending flange or lip 13. The cap 10 is adapted to fit on a container finish 14 which is formed with complimentary arranged threads 15 which cooperate with the threads 12 on the skirt 11. An inner, generally resilient, sealing disc 16 is carried within the cap 10, and when the cap is threaded onto the finish of the container, the sealing disc 16 will engage an upper rim of the finish of the container C. Beneath the threads 15 on the finish of the container is a radially, outwardly extending flange 17. In the case of a glass container formed in the usual or most common forming machines, this flange 17 also is termed a "transfer bead" and is the means by which the container formed in the blow mold is grasped by takeout tongs to transfer the container from the blow mold to a cooling deadplate. It should be noted that the outwardly extending flange 17 extends to approximately the same radius as does the flange or lip 13 on the closure 10.

In combination with the closure and container is a one-piece plastic tamper indicating band 18. The band 18 may be formed of a thermosetting plastic such as polyethylene or polypropylene of medium density such that it is fairly rigid when formed into a cylindrical band but is sufficiently flexible that it may act as a hinge when formed in a relatively thin area joining two relatively thicker sections.

The plastic must be resistant to tearing when of normal thickness but have sufficient tensile strength to resist separation in areas where it is formed fairly thin but still be subject to tearing along purposely formed, thin areas in order to be used where tearing provides for tamper indication. The band 18 is formed with a generally cylindrical wall portion 19. The cylindrical wall portion 19 adjacent, but spaced below its upper edge, there is formed an inwardly and upwardly extending locking ring 20. Adjacent the lower edge of the inside of the annular wall portion 19 there is formed an inwardly and downwardly extending locking ring 21. The locking rings 20 and 21 are joined to the band or ring 18 and are integrally molded therewith, with relatively thin connecting zones 22. As can be seen when viewing FIGS. 3 and 9, the attitude of the rings 20 and 21 at the time they are molded is such that they extend somewhat inwardly and upwardly in the case of ring 20 and inwardly and downwardly in the case of ring 21 at an obtuse angle with respect to the band 18. After molding, the rings 20 and 21 are moved toward each other and in effect become tucked, downwardly or upwardly depending on their relationship to the band, and they assume the position as illustrated in FIGS. 2, 11 and 12.

The tucking of the rings 20 and 21 into the positions illustrated is made possible by the fact that they are joined to the wall portion 19 of the band 18 by the thin section 22, with this thin zone or section 22 serving as a hinge. This is clearly illustrated in FIGS. 2, 3, 6, 7, 8, 10 and 12 where the locking ring is hingedly formed integrally with a cylindrical portion of a tamper indicating band.

It should be understood that the ring or rings 20, 21, 35, 36, 42 or 49 may be moved into the "tucked" position shortly after the molding operation before the plastic sets or at any time thereafter prior to being used with the container-closure combination. The ring will assume the "tucked" position when physically moved into this position and will remain in the position unless turned out physically to the "as-molded" position illustrated in FIG. 9. The "tucking" or untucking of the rings does not require any heating of the plastic and may be carried out with the plastic at room temperature. When the ring or rings are in their "as-molded" position they will remain in that position until being physically hinged inwardly. Thus the rings are bi-stable; i.e., each of the rings has two stable positions relative to the band. This is because the difference in the diameter of the circle described by the free edge 20 of the ring and the diameter of the circle described by the hinge area 22 is less than the actual distance from the hinge area 22 to the free edge 20 of the ring. When the free edges 20 or 21 of the ring are moved from the as molded position as shown in FIGS. 3 and 9 to the "tucked" or "folded-in" position as shown in FIGS. 11 and 12, the rings will pass from the one stable position of FIGS. 3 and 9 to the second stable position of FIGS. 11 and 12.

If the entire ring 20 were forced down, as a unit the ring would be put under radial compressive stress as the free edge approaches the horizontal plane passing through the hinge area 22 and would resist this movement until the edge 20 passed beneath the horizontal plane, at which time the ring edge 20 would drop or snap into the second stable position. It is easier to move the ring from a first position to the second position by progressively moving only a portion in a sort of folding action until the entire circumference of the ring has been tucked or "folded-in" in relation to the interior surface of the band. One way of moving the locking ring, such as ring 20, from its as-molded position to the locking or tucked position is by pushing the inner edge of the ring down at one area in its circumference with the thumb and progressively pushing down the adjacent areas until the full circumference has been pushed down below the top edge of the band. Another method of moving the locking ring into locking position from its as-molded position would be by engaging the ring with a beveled wheel while rotating the band about its central axis. This latter method is illustrated in U.S. patent application Ser. No. 728,377, filed Apr. 29, 1985, where a ring is attached to the lower skirt of a closure.

It can readily be seen that when the closure 10 is applied to the container C and threaded down to the point where the sealing disc 16 seals against the upper finish 14 of the container, the band 18 with its locking rings 20 and 21 may be telescoped downwardly about the outside circumference of the cap 10 and the lower locking ring 21 will pass by the flange 13 on the cap and also pass below the flange 17 on the container. The upper locking ring 20 may be pushed down to the point where its outwardly extending edge rests on the upper surface of the cap flange or lip 13 and the locking ring 21 will have its locking surface extending beneath the flange or transfer bead of the container C. In this manner, the cap and the container are locked in the position shown and removal of the cap by unthreading is prevented by the band 18. When it is desired to remove the band 18, it will be necessary to in some way destroy the integrity of the tamper indicating band 18.

For convenience, the band may be formed with a pair of spaced vertical, very thin weakened zones 23 and 24 and an outwardly extending tab 25 may be attached to the band intermediate the two weakened zones 23 and 24. Grasping the tab 25 and pulling downwardly, the ring 18 will tear along the zones 23 and/or 24. These zones also will extend into the locking rings 20 and 21 as well, and by tearing the band at one or the other of the weakened zones 23 or 24, the band 18 may be removed and the closure may then be unthreaded from the container. Thus it can be seen that the cap 10 with the container C, when provided with the locking ring or band 18 as disclosed, will provide a system indicating the integrity of the package, and only when the band or ring is tampered with is it possible to remove the closure or cap 10 from the container C. Additionally, to provide the tamper indication it is suggested that the ring 18 may be formed of a color other than that of the closure or cap 10 and thus making it even more evident that the ring has been tampered with. This is believed an advantage over those systems where the tamper indicating device is formed integral with the cap and therefore must necessarily assume the coloring of the cap as well. While it has been specifically shown that the band 18 is in combination with the cap 10 formed of a plastic material, it should be apparent that this system as specifically illustrated in FIGS. 1–3 would apply equally well to a metal closure 9, as shown in FIG. 10, of the type which has a rolled bead 8 formed at the bottom of the closure which would serve then as the locking ledge on the closure as does the flange or lip 13 formed with the plastic cap disclosed in the other embodiments.

For convenience, the ring 18 may be sold or marketed with the cap 10 and be carried therewith in its configuration as shown in FIG. 2. Then, when the cap is applied to the container by the capping device, it is only necessary that the capping device have a ring to engage the upper edge of the ring 18 to insure that the ring 18 becomes pushed vertically downward sufficient to have its ring 21 pass the flange 17 on the container and lock beneath this flange.

Turning now to FIG. 4, there is shown, in perspective, a second embodiment of a band 26 having a cylindrical wall portion 27 with a pair of vertical weakened zones 28 and 29 formed therein in a manner similar to the weakened zones 23 and 24 of the band 18 of the first embodiment of FIG. 1. The upper edge of the band 26 has a series of inwardly and downwardly extending generally rectangular shaped tabs 30. In a like manner, the lower edge of the band 26 is provided with and has formed integrally therewith a series of inwardly and upwardly extending tabs 31. It should be noted that the space between adjacent upper tabs 30 is of approximately the same size and location, vertically speaking, as the lower tabs 31. The formation of the tabs in the configuration shown in FIGS. 4 and 4*a* may be accomplished by having the forming die that forms the upper surface of the tabs 31 extend vertically downward from a point above the upper rim of the band 26. Likewise, the lower surface of the tabs 30 may be formed by a die that extends between adjacent lower tabs 31 vertically upward therebetween and to in effect be adjacent the upper surface of the inner side wall of the band 26.

With the embodiment shown in FIG. 4, it can be seen that its application to a closure and container configured as that shown in FIGS. 1 and 2 may be in the same manner as the band 18 was applied in the first embodiment. The band 26 may be telescoped downwardly over the cap 10 and again having its tabs 30 engage the flange or lip 13 of the closure or cap 10 and having the lower tabs 31 engage beneath the flange or transfer bead 17 of the container. Again, in this configuration the only way in which the closure can be unthreaded from the container is by destroying the band 26 in much the same manner as that described above with respect to the embodiment illustrated in FIG. 1. The band 26 has a tab 32, which may be molded integrally with the section between the weakened zones 28 and 29, and may be pulled and result in breaking the integrity of the band. With the band removed from the package, it will be obvious that the tamper indicating band has been removed and has been torn. It would be virtually impossible to restore the band to the package without leaving a clear indication of tampering with the package.

Turning now to FIGS. 5 and 6, there is shown a third embodiment of the invention of a tamper indicating ring generally designated 33. The ring 33 is formed as a cylindrical band 34 to the upper and lower edges of which are integrally molded a pair of locking rings 35 and 36. The rings 35 and 36 are molded and joined to the band 34 in the manner previously described with respect to FIG. 3 and the first embodiment, and then are moved or mechanically pushed inwardly, and in the case of the band 35, downwardly, and in the case of the band 36, upwardly, to assume the position illustrated in FIGS. 5 and 6. Intermediate the locking rings 35 and 36, at a position as shown in FIGS. 5 and 6, the band 34 is formed with an inwardly extending flange or ledge 37. As can readily be seen from FIG. 5, the flange or ledge 37 is generally horizontal and extends radially inward with respect to the band 34 and is interrupted at a circumferential position at 38. The position 38 corresponds to a tear strip 39 formed by weakened zones as explained with respect to FIGS. 1 and 4. The tear strip is provided with an outwardly extending pull tab 40 by which the tear strip 39 may be torn from the band 34 when it is desired to remove the locking band from the closure and/or container. The flange or ledge 37 is configured and formed integral with the wall 34 at a position such that the lip 13 of the cap 10 may engage the upper surface of the flange 37 while the locking ring 35 engages the upper surface of the ledge 13. In commercial operations, the closure 10 in FIG. 6 is applied to the container with the locking or tamper indicating band 33 applied to and carried by the closure 10. The band 33 can be assembled to the closure 10 merely by vertically telescoping the band upward over the lower rim of the closure or cap until the ring 35 engages the upper surface of the flange or lip 13 of the cap 10. With the closure and band so assembled, it can readily be seen that the normal application of the threaded closure to a container will result in the flange or ledge 37 assisting in the holding of the band 34 in the position shown in FIG. 6, and assisting in the movement of the locking ring 36 over the flange 17 of the container C to effect the application of the band 33 to the container-closure combination as illustrated in FIG. 6.

While the flange or ledge 37 is shown in FIG. 5 as a generally continuous, inwardly extending strip, it should be apparent that this strip or ledge 37 could be a series of segmented sections such as that illustrated by the plurality of tabs 30 and 31, although in the case of the flange or ledge 37 these tabs or segments would extend inwardly in the general configuration of the flange 37.

A fourth embodiment of the band or ring of the invention is illustrated in FIG. 7 wherein a sectional view is given of a vertical band 41, it being understood that the band is a continuous cylindrical band extending about a cap and container finish as are the previously disclosed embodiments. Again, the cap 10 and container C are of identical configuration to those disclosed with respect to the previous embodiments. In this embodiment, the band 41 is provided with an upper locking ring 42 which is adapted to be seated against the upper surface of the cap flange or lip 13. The lower edge of the band 41 is provided with an inwardly extending, generally flat, radial ledge 43. The ledge 43 is a continuous ledge intended to be configured such that it seats beneath the flange or transfer bead 17 of a glass container C. In the configuration shown, the band 41 may be carried by the container and the application of the cap by downward threading would permit the locking ring 42 to pass by the flange or lip 15 of the cap 10. In this embodiment, the locking ring 42 may be a continuous ring such as that shown in FIG. 1 with respect to ring 20 or may be configured as interrupted segments as illustrated in FIG. 4 with the tabs 30.

Turning now to FIG. 8, a fifth embodiment is illustrated. This embodiment is similar to FIG. 7 except the ledge and locking ring are reversed and a continuous cylindrical band 44 is formed with an inwardly extending, radial ledge 45 which seats on a relatively small flange 46 on the lower skirt portion 47 of a cap 48. The lower edge of the band 44 is formed with an inwardly and upwardly extending locking ring 49. Again, as in the previous embodiments, this locking ring 49 may be a continuous ring extending circumferentially about the lower edge of the band 44 and molded in an open position such as shown in FIGS. 3 and 9, then turned upwardly and inwardly mechanically to the position shown in FIG. 8 at 49, or it may be formed as a discontinuous ring made of a plurality of tabs such as the tabs 31 illustrated in FIG. 4. With the configuration of the tamper indicating band 44 of the embodiment shown in FIG. 8, the band 44 would normally be assembled with the cap 48, and when the cap is applied to the container and threaded down to be sealed thereto, the band 44 would be held with its flange 45 against the flange 46 of the cap 48, causing the locking ring 49 to engage beneath the transfer bead or flange 17 of the container C.

With the tamper indicating system of the invention as illustrated and described with respect to FIGS. 1–12, it can be seen that a band provided about the lower edge of the closure or cap and the lower area of the transfer bead of the container is such that it will maintain the cap and container in threaded engagement unless it is severed or destroyed in the removal of the cap from the container. In both of the embodiments of FIG. 7 and FIG. 8, it should be remembered that a tear strip would be provided as is the case of the earlier embodiments disclosed.

In the previously described embodiments, where the locking ring or rings is molded integrally with the band and is joined to the band by a thin hinge section, the ring is molded with an obtuse angle "X", such as shown in FIG. 3. The reason that such a configuration is adopted is that in order to injection mold the annular, cylindrical article, it is necessary to be able to mold the rings with the band and still be able to strip the rings from the circular mold. The rings 20 and 21 can be stripped when in the molded configuration of FIGS. 3 and 9. If the band and rings were molded at the angle "Y" of FIG. 12 in the shape or configuration of FIGS. 11 and 12, it would be impossible to strip the rings from the mold without having an extremely complicated internal die that would be able to withdraw from the angle "Y" and retract from the inner surface of wall 19 an amount which would provide the clearance for the rings 20 and 21. Since Applicant has determined that each of the rings is bi-stable when formed as shown in FIG. 9, then the easier forming mode was chosen.

Of course, with the embodiments of FIGS. 4 and 4*a*, there is no requirement of stripping the tabs over an internal die since they are molded, as shown and as explained before.

Another aspect of the present invention is the fact that the band is an integrally formed one-piece member and that it is not required that it be formed with the closure as is the case in many tamper indicating systems. Thus the band may be formed of a different colored material than that of the cap, and its presence or absence would be clearly discernible, and also once the band is broken or tampered with, it would be readily apparent if someone were to try to reattach the band to the cap and the container. While the container illustrated in the above-described embodiments of the present invention is a glass container, it should be apparent that the container could be a plastic container or a metal container having a transfer bead or similar configuration to the bead 17 of the glass container C, thus providing a lower radially outwardly extending ledge beneath which the locking ring system of the present invention would be positioned.

I claim:

1. A tamper indicating band in combination with a closure having a lower radially, outwardly extending lip and a container having a radial flange beneath and adjacent said lip, said band comprising an annular molded plastic band of a height greater than the vertical spacing between the closure lip and the container flange, a first inwardly extending locking means integrally formed with the inner surface of said band adjacent one edge thereof and engaging the top of said closure lip, a second inwardly extending locking means integrally formed with the inner surface of said band adjacent the other edge thereof and adapted to engage beneath said container flange and said band spanning the space between the closure lip and container flange.

2. The tamper indicating band, closure and container combination of claim 1 wherein said first and second inwardly extending locking means comprises continuous annular rings joined to the inner surface of said band at an acute angle with respect to the inner surface of said band by a thin hinge section.

3. The tamper indicating band, closure and container combination of claim 2 further including a radial, inwardly extending annular ledge intermediate the upper and lower edges of said band, said annular ledge adapted to be engaged by a lower rim of the closure to assist in the assembly of the closure and band to a container.

4. The tamper indicating band, closure and container combination of claim 2, further including a vertical, weakened section in said band, with means adjacent said weakened section for aiding in separating said band at said weakened section.

5. The tamper indicating band, closure and container combination as set forth in claim 2 wherein said closure is formed of metal.

6. The tamper indicating band, closure and container combination as set forth in claim 2 wherein said container and closure are formed of plastic.

7. The tamper indicating band, closure and container combination of claim 1, wherein said first and second inwardly extending locking means comprises a plurality of rectangular tabs with the tabs that extend from adjacent the upper edge of said band extending downwardly at an acute angle with respect to the inner surface of the band and the tabs that extend from adjacent the lower edge of said band extend upwardly at an acute angle with respect to the inner surface of said band.

8. The tamper indicating band, closure and container combination of claim 7 wherein the tabs that are joined adjacent to the upper edge of said band are offset vertically from the tabs that are joined adjacent to the lower edge of said band.

9. The tamper indicating band, closure and container combination of claim 7, further including a vertical, weakened section in said band, with means adjacent said weakened section for aiding in separating said band at said weakened section.

10. The tamper indicating band, closure and container combination of claim 1, further including a vertical, weakened section in said band, with means adjacent said weakened section for aiding in separating said band at said weakened section.

11. A tamper indicating band in combination with a closure having a lower radially, outwardly extending lip and a container having a radial flange beneath and adjacent said closure lip, said band comprising an annular molded plastic band of a height greater than the vertical spacing between the closure lip and the container flange, a first inwardly, extending locking means integrally formed as a continuous annular ring joined to the inner surface of said band at an acute angle with respect to the inner surface of said band by a thin hinge section adjacent one edge thereof and engaging the top of said closure lip, a second inwardly extending locking means integrally formed with the inner surface of said band, adjacent the other edge thereof and adapted to engage beneath said container flange and said band spanning the space between the closure lip and container flange.

12. The tamper indicating band, closure and container combination of claim 11, further including a vertical, weakened section in said band, with means adjacent said weakened section for aiding in separating said band at said weakened section.

13. A tamper indicating band in combination with a closure having a lower radially, outwardly extending lip and a container having a radial flange beneath and adjacent said lip, said band comprising an annular molded plastic band of a height greater than the vertical spacing between the closure lip and the container flange, a first inwardly extending locking means integrally formed with the inner surface of said band adjacent one edge thereof and engaging the top of said closure lip, a second inwardly extending locking means formed as a continuous annular ring joined to the inner surface of said band at an acute angle with respect to the inner surface of said band by a thin hinge section, said second locking means engaging beneath the container flange.

14. The tamper indicating band, closure and container combination of claim 13, further including a vertical, weakened section in said band, with means adjacent said weakened section for aiding in separating said band at said weakened section.

15. A tamper indicating band in combination with a closure having a lower radially, outwardly extending lip and a container having a radial flange beneath and adjacent said lip, said band comprising an annular molded plastic band of a height greater than the vertical spacing between the closure lip and the container flange, a first inwardly extending locking means integrally formed as a continuous annular ring joined to the inner surface of said band at an acute angle with respect to the inner surface of said band by a thin hinge section adjacent one edge thereof and engaging the top of said closure lip, a second inwardly extending locking means formed as a generally horizontal, inwardly extending annular ledge, integrally formed with said band at the other edge thereof, said ledge extending beneath and engaging the container flange and said band spanning the space between the closure lip and container flange.

16. A tamper indicating band in combination with a closure having a lower radially, outwardly extending lip and a container having a radial flange beneath and adjacent said closure lip, said band comprising an annular molded plastic band of a height greater than the vertical spacing between the closure lip and the container flange, a first inwardly extending locking means, formed as a generally horizontal, inwardly extending annular ledge integrally formed with said band at one edge thereof, said ledge extending over and engaging the top of the closure lip, a second inwardly extending locking means formed as a continuous annular ring joined to the inner surface of said band adjacent the other edge thereof at an acute angle with respect to the inner surface of said band by a thin hinge section, said second locking means engaging beneath the container flange and said band spanning the space between the closure lip and container flange.

* * * * *